United States Patent [19]

Richardson

[11] Patent Number: 4,578,016

[45] Date of Patent: Mar. 25, 1986

[54] SHINGLE LOADING LADDER

[76] Inventor: John H. Richardson, 804 Duck Rd., Grandview, Mo. 64030

[21] Appl. No.: 506,201

[22] Filed: Jun. 20, 1983

[51] Int. Cl.[4] ..... E06C 1/00; E06C 7/16

[52] U.S. Cl. ..... 414/680; 254/266; 52/120; 182/129

[58] Field of Search ..... 414/680, 729; 182/86, 182/97, 129; 52/116, 120, 747–750; 254/142

[56] References Cited

U.S. PATENT DOCUMENTS

| | | | |
|---|---|---|---|
| 528,938 | 11/1894 | Goodwin | 182/129 |
| 535,742 | 3/1895 | Sooy . | |
| 570,939 | 11/1896 | Mack . | |
| 1,386,511 | 8/1921 | Krahl | 182/129 |
| 2,800,371 | 7/1957 | Quercetti | 304/10 |
| 3,902,700 | 9/1975 | Cox | 254/142 |
| 3,903,991 | 9/1975 | Phelan | 182/93 |
| 4,397,375 | 8/1983 | Hart | 182/129 |

FOREIGN PATENT DOCUMENTS

| | | | |
|---|---|---|---|
| 555715 | 2/1960 | Belgium | 182/129 |

*Primary Examiner*—Terrance L. Siemens

*Attorney, Agent, or Firm*—D. A. N. Chase; Michael Yakimo, Jr.

[57] ABSTRACT

An attachment for a conventional ladder comprises first and second mounting arms, support arms and leg members arranged to present a cradle for receiving at least one bundle of shingles therein. Subsequent to insertion of the shingles into the cradle, the ladder is rotated about a pivot bar so as to swing the ladder and shingle-laden cradle between ground-adjacent and roof-adjacent positions. Upon reaching the latter position, a roof-adjacent worker removes the shingles from the cradle and the ladder is subsequently swung to a ground-adjacent, shingle loading positioning for subsequent loading of another bundle of shingles thereon. The process is repeated until the desired quantity of shingle bundles are loaded on the roof for subsequent installation thereon.

35 Claims, 6 Drawing Figures

4.
4.
6.
6.
22
24
30
32
36
36a
44
50a
50b
76
78
79
80
90
100
102
64

SHINGLE LOADING LADDER

BACKGROUND OF THE INVENTION

This invention relates to an improved ladder and, more particularly, to a ladder adapted to raise roof shingles from a ground-adjacent position to an elevated position adjacent a house roof for a subsequent unloading thereon.

Heretofore, the most common method utilized in loading shingles onto a house roof has been for the roofers to repeatedly carry bundles of shingles up the ladder to the roof for subsequent placement thereon. In some instances, particularly toward the end of the work load, the legs of the worker may become weary. In turn, the fatigued worker may become careless and loose his footing on the ladder which can lead to drastic results.

In response thereto, I have invented an attachment for a ladder which effectively elevates bundles of shingles from the ground to the roof line for subsequent unloading by a roof-adjacent worker onto the roof so as to alleviate the necessity for workers to repeatedly carry the bundles of shingles up a ladder.

Generally, my attachment comprises a cradle assembly fastened adjacent the upper end of the ladder which extends above the eave line of the roof upon rotation of the ladder into a generally upstanding position. A pivot bar extends between the lower ends of the laterally spaced-apart side rails of the ladder to present a ground-adjacent axis of rotation of the ladder to the side rails. Initially, the ladder is placed in a ground-adjacent position allowing for insertion by a ground-adjacent worker of a bundle of shingles into the cradle assembly. Subsequently, a worker on the roof takes up a rope attached to the ladder which causes rotation of the ladder about the pivot bar to a position presenting the shingle-laden cradle to the roof-adjacent worker. Upon removal of the bundles from the cradle, the rope is slackened causing the ladder to rotate about the pivot bar to the ground-adjacent position for subsequent loading of a bundle of shingles thereon. This process is repeated until the desired bundles of shingles are loaded on to the roof. The cradle assembly is mounted to the ladder in a manner preventing undesirable movement of the shingles during rotation of the ladder from the ground adjacent to the elevated position.

It is therefore a general object of this invention to provide an attachment for a ladder which assists workers in loading bundles of roofing shingles onto the roof.

It is another object of this invention to provide an attachment, as aforesaid, which utilizes rotation of a normal ladder about a ground-adjacent pivot so as to move the shingle-laden ladder from a ground-adjacent to an elevated position presenting the bundle of shingles to the roofer.

A still more particular object of this invention is to present an attachment for a ladder, as aforesaid, which precludes undesirable shifting of the shingles during said ladder rotation.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 4:
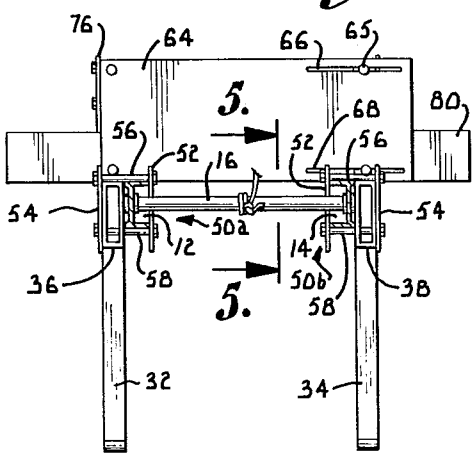
FIG. 4 is an elevation view, taken along lines 4—4 in FIG. 3, showing the basal structure of the cradle assembly and its means of attachment to the ladder.
Figure 5:
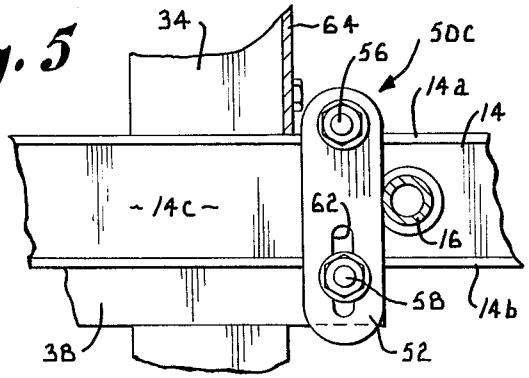
FIG. 5 is a sectional elevation view, taken along lines 5—5 in FIG. 4, and showing one mounting bracket of the cradle assembly.
Figure 1:
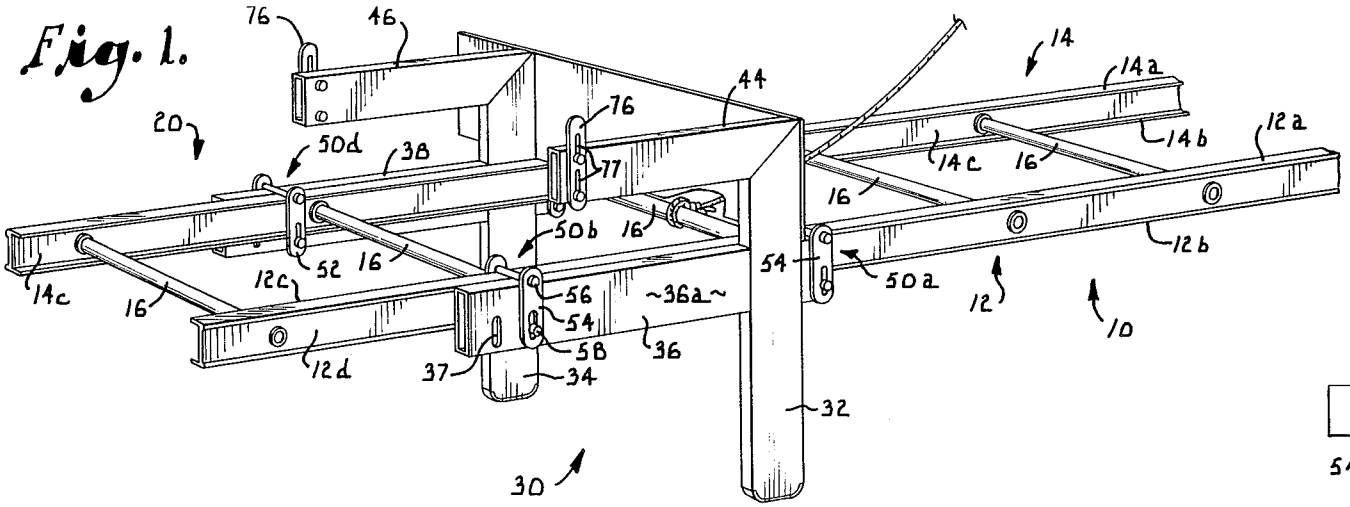
FIG. 1 is a perspective view of the upper end of the ladder and showing a shingle-receiving cradle assembly mounted thereto.
Figure 2:
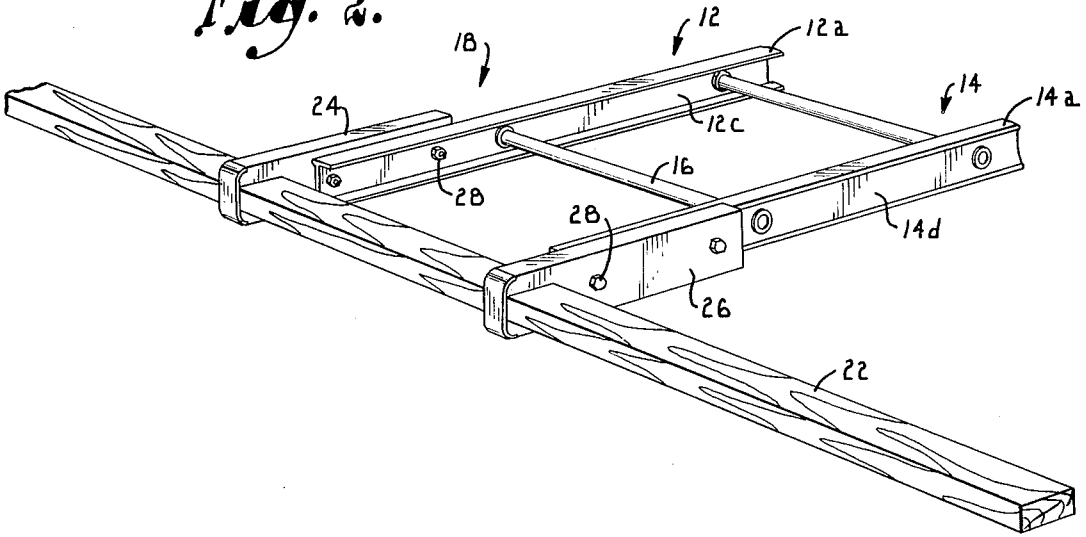
FIG. 2 is a perspective view of the lower end of the ladder and showing the pivot bar mounted thereto.

Turning more particularly to the drawings, FIG. 1 illustrates the upper end of a ladder 10 having first 12 and second 14 laterally spaced-apart side rails with a plurality of longitudinally spaced-apart rungs 16 spanning therebetween. Each side rail 12, 14 comprises front **12*a*, 14*b* and back 12*b*, 14*b* walls and interior 12*c*, 14*c*, and exterior 12*d*, 14*d*** flange-like side walls.

Extending between the lower end 18 of the respective side rails 12, 14 is a pivot bar 22 having mounting arms 24 and 26 normally extending therefrom and attached to the exterior walls **12*d*, 14*d* of the respective side rails 12, 14 by bolt/nut combinations 28**.

Mounted to the upper end 20 of the lader 10 is a cradle assembly generally designated as 30. The cradle assembly 30 comprises left 32 and right 34 cradle arms having mounting beams 36 and 38 normally extending therefrom. Left and right leg members 44, 46 normally extend from one end of each cradle arm 32, 34 and lie parallel to the respective mounting beams 36, 38 and, upon mounting, to the adjacent side rails 12, 14. The top, free end of each leg member 44, 46 is spaced away from the mounting beam 36, 38 and front face **12*a*, 14*a* of each side rail 12, 14 presenting an opening allowing for insertion of shingles 80** therebetween.

The cradle assembly 30 is mounted to the upper end 20 of the ladder 10 by means of mounting brakets **50*a*, 50*b*, 50*c* and 50*d* joining each mounting beam 36, 38 to a respective exterior wall 12*d*, 14*d* of each side rail 12, 14. Each bracket 50 includes inside and outside plate members 52, 54, relative to the side rails 12, 14, with connecting bolts 56, 58 extending therebetween. The outside plate 54 transverses the exterior surface 36*a*, 38*a* of the respective mounting beam 36, 38 with the inside plate 52 transversing the interior surfaces 12*c*, 14*c* of the respective side rails 12, 14. Bolt 56 of each mounting bracket 50 transversely abuts the front face of the respective mounting beams 36, 38 and side rail 12*a*, 14*a*. Bolt 58 passes through the exterior plate 54, respective mounting arm 36, 38 and transversely abuts the rear face 12*b*, 14*b* of the respective side rail 12, 14. Slots 62 in the mounting plates 52, 54 are aligned with slots 37 in the respective mounting beam 36, 38 to allow for slidable movement of bolts 58 therealong. Thus, the brackets 50 can attach the mounting beams 36, 38 to side rails 12, 14 having various dimensions between the front 12*a*, 14*a* and back 12*b*, 14*b* walls. Furthermore, the slidable adjustment of the respective bolts 58, so as to lie contiguous to the opposed surfaces 12***a*, 12*b*, and 14*a*, 14*b* of the respective side rails 12 and 14, precludes shifting of the mounting beams 36, 38 and cradle assembly 30 relative to these side rails. Also, upon mounting the underside of each interior mounting plate 52 rests on an inferiorly disposed rung 16 which offers underlying support to the bracket 50 so as to preclude longitudinal shifting of the mounting beams 36, 38 and entire cradle assembly 30 during use.

Extending between the support arms 32, 34 is a shelf member 64 offering basal support to the shingles 80 as well as rigidity to the cradle assembly 30. Slots 66, 68 in the shelf allow for lateral adjustment of the cradle arm 34 therealong as fastened thereto by bolts 65. Accordingly, the lateral displacement of the support arms 32, 34 is user adjustable without interference from the underlying shelf 64.

Atop the free end of each cradle leg 44, 46 is a retaining bracket 76 transversely slidable along slots 77 and held thereat by a friction-like bearing of washers 78 of the two bolt/nut combination 79. A spring bias may be associated with each bracket 76 if desired. Each bracket 71 is user-insertable into the space adjacent the respective cradle leg 44, 46 for a purpose to be subsequently described.

Figures 3, 6:
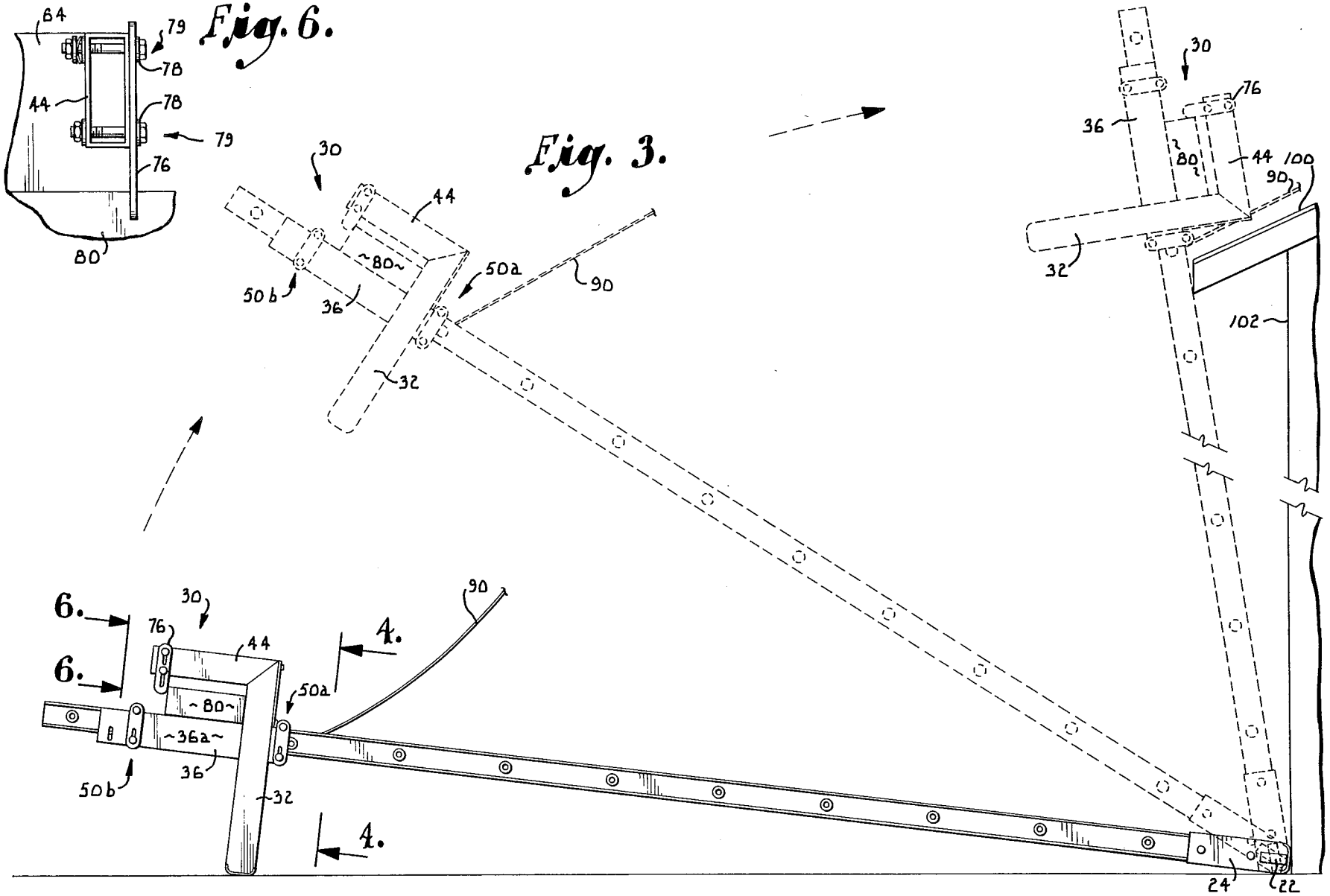
FIG. 3 is a series of elevation views showing the shingle-laden cradle and ladder in ground-adjacent, intermediate and elevated positions.
FIG. 6 is an elevation view, taken along lines 6—6 in FIG. 3 and showing a retaining bracket of the cradle assembly.

In use, the ladder 10 with cradle assembly 30 thereon is placed in a ground-adjacent position as shown in FIG. 1 and in solid lines in FIG. 3. A bundle of shingles 80 is placed by a ground-adjacent worker between the cradle legs 44, 46 and respective side rails 12 and 14. Retaining brackets 76 are then shifted along slots 77 so as to abut the top edge of the shingles 80 as shown in FIG. 3.

As shown in FIG. 3, the pivot bar 22 has been placed against a wall 102 of the house 72 so as to preclude undesirable sliding of the pivot bar 22 and ladder 10 along the ground. (Other means to preclude slippage of this pivot bar 22 may also be utilized such as by driving retaining stakes into the ground in front of the pivot bar.) The slack of rope 90, attached to a rung 16, adjacent shelf 64, is taken up by a roof-adjacent worker. This take-up causes rotation of the ladder 10 about pivot bar 22 and thus a concurrent swinging of the shingle 80-laden cradle 30 through a vertical arc and through the three positions shown in FIG. 3. Upon reaching a position which presents the single-laden cradle 30 above the roof eaves, i.e. the right-most position in FIG. 3, the ground-adjacent worker holds the ladder 10 in place. The roof-adjacent worker then slides the retaining brackets 76 to a position allowing for removal of the shingle bundle 80 from the cradle 30 for subsequent unloading onto the roof 100. The taut rope 90 is then slackened allowing the ladder 10 to rotate in a contra direction about pivot bar 22 to its ground-adjacent position. A subsequent load of shingles 80 is then inserted into the cradle 30 by the ground-adjacent worker. This process is repeated until the desired quantity of shingle bundles 80 are loaded atop the roof 100 for subsequent installation thereon.

It is here noted that the ground-adjacent worker may assist the roof-adjacent worker in swinging the ladder 10 between the above-described positions.

It is to be understood that while certain forms of this invention have been illustrated and described, it is not limited thereto, except in so far as such limitations are included in the following claims.

I claim:

1. For use with a conventional ladder having first and second parallel side rails with a plurality of parallel rungs laterally extending therebetween, structure for raising ground-adjacent material, such as shingles, to the roof of a structure comprising:

an imaginary axis of rotation extending between the bottom ends of said side rails;

cradle means attached to said ladder adjacent the upper end thereof for releasably engaging said material therein, said cradle comprising:

first and second support arms;

means for mounting said respective support arms to a respective side rail in a direction extending away from said side rails; and a leg member extending from each support arm and towards the upper end of said ladder, each leg member terminating in an end spatially adjacent said respective side rail to allow for insertion of said material therebetween, said support arms offering basal support and cooperating with said leg members to maintain said material in place during ladder rotation; and means for rotating said ladder about said axis between ground-adjacent and upstanding positions to concurrently raise the cradle and present the same to a user on said roof for release of said material from said cradle.

2. The apparatus as claimed in claim 1 further comprising a shelf member extending between said support arms for providing basal support to said shingles during said ladder rotation.

3. The apparatus as claimed in claim 1 further comprising a bracket member mounted at a top end of said leg member, said bracket member releasably extendable into the space between said leg and said side rail for extension above said material to maintain said material in said cradle during said ladder rotation.

4. The apparatus as claimed in claim 1, wherein said mounting means comprises:

a mounting arm displaced from said leg member and extending from each respective support arm; and means for fastening said respective mounting arm to an exterior surface of said respective side rail.

5. The apparatus as claimed in claim 4, wherein said fastening means comprises at least one bracket assembly for joining each mounting arm to the respective side rail and including:

a first plate positioned adjacent the outside surface of said mounting arm;

a second plate laterally spaced from said first plate member and positioned to the inside of said side rail; and means for joining said first plate to said second plate with said mounting arm and side rail interposed therebetween whereby to secure said mounting arm to said respective side rail.

6. The apparatus as claimed in claim 5, wherein said second plate abuts a surface of each respective side rail to preclude lateral movement of said bracket and said mounting arm relative to said side rail.

7. The apparatus as claimed in claim 5, wherein said second plate rests atop a rung of said ladder to preclude longitudinal movement of said bracket and said mounting arm along said side rail.

8. The apparatus as claimed in claim 5, wherein said joining means comprises:

a first bolt extending between said plates and transversing a surface of said side rail;

a second bolt extending between said plates and transversing an opposed surface of said rail; and means for positioning said bolts in a position abutting said opposed surfaces of said side rail to preclude movement of said associated mounting arm relative thereto.

9. The apparatus as claimed in claim 1, further comprising a bar member extending between said side rails at the lower end thereof to present said axis of rotation.

10. The apparatus as claimed in claim 9 further comprising means for maintaining said bar in place to preclude slippage of said axis and said ladder during said rotation.

11. The apparatus as claimed in claim 9, wherein said bar is positioned against an exterior wall of said structure, said wall presenting said means for maintaining said pivot bar in place.

12. The apparatus as claimed in claim 1, wherein said rotating means comprises a rope having one end fastened to said ladder and operable by the user in a manner whereby a take-up of said rope causes rotation of said ladder about said axis.

13. For use with a conventional ladder having first and second parallel side rails with a plurality of parallel rungs laterally extending therebetween, structure for raising ground-adjacent material such as shingles to the roof of a structure comprising:

an imaginary axis of rotation extending between said side rails;

a cradle assembly attached to said ladder adjacent the upper end thereof for releasably engaging said material therein, said cradle comprising:

at least one support arm extending away from said ladder in a direction generally normal thereto; and a leg member extending from said support arm and towards the upper end of said ladder, said leg member displaced from said ladder to allow for insertion of said material therebetween;

means for fastening said cradle to said ladder adjacent the upper end thereof in a manner to preclude movement of said cradle relative to said ladder said fastening means comprising:

a mounting arm extending from each support arm and along one of said side rails;

a bracket member including first and second plate members with one of said plate members abutting the inside of said side rail and the other of said plate members abutting said mounting arm; and means for releasably fixing said plate members in said abutting relationships to resist their movement relative to said side rail; and means for rotating said ladder about said axis between ground-adjacent and upstanding positions to concurrently raise the cradle and present the same to a user on said roof for release of said material from said cradle.

14. The apparatus as claimed in claim 13, wherein said bracket member rests atop a rung of said ladder to resist longitudinal movement of said bracket member and mounting arm along said ladder during said ladder rotation.

15. For use with a conventional ladder having first and second parallel side rails with a plurality of parallel rungs laterally extending therebetween, structure for raising ground-adjacent material to the roof of a structure comprising:

an imaginary axis of rotation extending between the bottom ends of said side rails;

cradle means attached to said ladder adjacent the upper end thereof for releasably engaging said material therein said cradle comprising:

first and second support arms;

means for mounting said respective support arms to a respective side rail in a direction extending away from said side rail; and a leg member extending from each support arm and towards the upper end of said ladder, each leg member terminating in an end spatially adjacent said respective side rail to allow for insertion of said material therebetween, said support arms offering basal support and cooperating with said leg members to maintain said material in place during ladder rotation; and a bracket member mounted on each leg member, said bracket member releasably extendable into the space between said leg and said side rail for extension above said material to maintain said material in said cradle during said ladder rotation; and means for rotating said ladder about said axis between ground-adjacent and upstanding positions to concurrently raise the cradle and present the same to a user on said roof for release of said material from said cradle.

16. The apparatus as claimed in claim 15 further comprising a shelf member extending between said support arms for providing further basal support to said material during said ladder rotation.

17. The apparatus as claimed in claim 15, wherein said mounting means comprises:

a mounting arm displaced from said leg member and extending from each respective support arm; and means for fastening said respective mounting arm to an exterior surface of said respective side rail.

18. The apparatus as claimed in claim 17, wherein said fastening means comprises at least one bracket assembly for joining each mounting arm to the respective side rail and including:

a first plate positioned adjacent the outside surface of said mounting arm;

a second plate laterally spaced from said first plate member and positioned on the inside of said side rail; and means for joining said first plate to said second plate with said mounting arm and side rail interposed therebetween whereby to secure said mounting arm to said respective side rail.

19. The apparatus as claimed in claim 18, wherein said second plate abuts a surface of each respective side rail to preclude movement of said bracket and said mounting arm away from said side rail.

20. The apparatus as claimed in claim 18, wherein said second plate rests atop a rung of said ladder to preclude longitudinal movement of said bracket and said mounting arm along said side rail.

21. The apparatus as claimed in claim 18, wherein said joining means comprises:

a first bolt extending between said plates and traversing a surface of said side rail;

a second bolt extending between said plates and traversing an opposed surface of said side rail; and means for positioning said bolts in a position abutting said opposed surfaces of said side rail to preclude movement of said associated mounting arm relative thereto.

22. The apparatus as claimed in claim 15 further comprising a bar member extending between said side rails at said bottom ends thereof to present said axis of rotation.

23. The apparatus as claimed in claim 22 further comprising means for maintaining said bar in place to preclude slippage of said axis and said ladder during said rotation.

24. The apparatus as claimed in claim 22, wherein said bar is positioned against an exterior wall of the house, said wall presenting said means for maintaining said pivot bar in place.

25. The apparatus as claimed in claim 15, wherein said rotating means comprises a rope having one end fastened to said ladder and operable by a user in a manner whereby a take-up of said rope causes rotation of said ladder about said axis.

26. For use with a conventional ladder having first and second parallel side rails with a plurality of parallel rungs laterally extending therebetween, structure for raising ground-adjacent material, e.g. shingles, to the roof of a structure comprising:

an imaginary axis of rotation extending between the bottom ends of said side rails;

cradle means attached to said ladder adjacent the upper end thereof for releasably engaging said roofing material therein, said cradle comprising:

first and second support arms;

means for mounting said respective support arms to a respective side rail in a direction extending away from said side rail, said mounting means comprising:

a mounting arm displaced from each leg member and extending from each respective support arm; and bracket means for fastening said respective mounting arm to an exterior surface of said respective side rail, said fastening means comprising:

a first plate positioned adjacent the outside surface of said mounting arm;

a second plate laterally spaced from said first plate member and positioned to the inside of said side rail; and means for joining said first plate to said second plate with said mounting arm and side rail interposed therebetween whereby to secure said mounting arm to said respective side rail;

a leg member extending from each support arm and towards the upper end of said ladder, each leg member terminating in an end spatially adjacent said respective side rail to allow for insertion of said material therebetween, said support arms offering basal support to said material and cooperating with said leg members to maintain said material in place during a rotation of said ladder about said axis; and means for rotating said ladder about said axis between ground-adjacent and upstanding positions to concurrently raise the material-laden cradle and present the same to a user on said roof for release of said material from said cradle.

27. The apparatus as claimed in claim 26 further comprising a shelf member extending between said support arms for providing further basal support to said material during said ladder rotation.

28. The apparatus as claimed in claim 26 further comprising a bracket member mounted on each leg member, said bracket member releasably extendable into the space between said leg and said side rail for extension above said material to maintain said material in said cradle during said ladder rotation.

29. The apparatus as claimed in claim 24, wherein said second plate abuts a surface of each respective side rail to preclude lateral movement of said bracket and said mounting arm relative to said side rail.

30. The apparatus as claimed in claim 26, wherein said second plate rests atop a rung of said ladder to preclude longitudinal movement of said bracket and said mounting arm along said side rail.

31. The apparatus as claimed in claim 26, wherein said joining means comprises:

a first bolt extending between said plates and traversing a surface of said side rail;

a second bolt extending between said plates and traversing an opposed surface of said rail; and means for positioning said bolts in a position abutting said opposed surfaces of said side rail to preclude movement of said associated mounting arm relative thereto.

32. The apparatus as claimed in claim 26 further comprising a bar member extending between said side rails at the lower end thereof to present said axis of rotation.

33. The apparatus as claimed in claim 32 further comprising means for maintaining said bar in place to preclude slippage of said axis and said ladder during said rotation.

34. The apparatus as claimed in claim 32, wherein said bar is positioned against an exterior wall of said structure, said wall presenting said means for maintaining said pivot bar in place.

35. The apparatus as claimed in claim 26, wherein said rotating means comprises a rope having one end fastened to said ladder and operable by the user in a manner whereby a take-up of said rope causes rotation of said ladder about said axis.

* * * * *

UNITED STATES PATENT AND TRADEMARK OFFICE

CERTIFICATE OF CORRECTION

PATENT NO. : 4,578,016

DATED : March 25, 1986

INVENTOR(S) : John H. Richardson

It is certified that error appears in the above—identified patent and that said Letters Patent is hereby corrected as shown below:

Column 3, last line, delete "I claim:", and insert --Having thus described the invention, what is claimed as new and desired to be secured by Letters Patent is:--;

Column 8, line 21, Claim 29, delete "24," and insert --26,-- therein.

Signed and Sealed this

*Fifteenth* Day of *July 1986*

[SEAL]

*Attest:*

DONALD J. QUIGG

*Attesting Officer*

*Commissioner of Patents and Trademarks*